US006376145B1

(12) United States Patent
Meyer

(10) Patent No.: US 6,376,145 B1
(45) Date of Patent: Apr. 23, 2002

(54) ULTRASONIC DRYING OF SATURATED POROUS SOLIDS VIA SECOND SOUND

(75) Inventor: Robert J. Meyer, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/699,876

(22) Filed: Oct. 30, 2000

(51) Int. Cl.[7] ..... G03G 13/20
(52) U.S. Cl. ..... 430/97; 34/279
(58) Field of Search ..... 430/124, 125, 430/97; 34/279

(56) References Cited

U.S. PATENT DOCUMENTS

| | | | | |
|---|---|---|---|---|
| 4,729,175 A | * | 3/1988 | Beard et al. | 31/1 |
| 5,171,387 A | * | 12/1992 | Wuchinich | 156/73.3 |
| 5,223,368 A | | 6/1993 | Ciccarelli et al. | 430/110 |
| 5,492,788 A | | 2/1996 | Denton et al. | 430/137 |
| 6,119,367 A | * | 9/2000 | Kamikawa et al. | 34/401 |

OTHER PUBLICATIONS

M.A. Biot, *Theory of Propagation of Elastic Waves in a Fluid–Saturated Porous Solid*, Mar. 1956, 168.

M.A. Biot, *Theory of Propagation of Elastic Waves in a Fluid–Saturated Porous Solid*, Mar. 1956, 179.

M.A. Biot, *Mechanics of Deformation and Acoustic Propagation in Porous Media*, Apr. 1962, 1482.

D.L. Johnson, T.J. Plona and H. Kojima, *Probing Porous Media with First and Second Sound. II. Acoustic Properties of Water–Saturated Porous Media*, Mar. 1994, 115.

T.J. Plona, R. D'Angelo and D.L. Johnson, *Velocity and Attentuation of Fast, Shear and Slow Waves in Porous Media*, 1991, 1233–1239.

S. Torquato, *Random Heterogeneous Media: Microstructure and Improved Bounds on Effective Properties*, Feb. 1991, 37.

J.E. White, *Seismic Waves: Radiation, Transmission and Attenuation*, 1965, 70.

W.A. Gray, *The Packing of Solid Particles*, 1968, 34.

* cited by examiner

*Primary Examiner*—John Goodrow
(74) *Attorney, Agent, or Firm*—Lloyd F. Bean, II

(57) ABSTRACT

A method for drying a porous solid saturated with a fluid including the steps of subjecting the saturate porous image to an ultrasonic signal to release the fluid from the saturated porous image layer; removing the fluid from said saturated porous solid, said subjecting step includes applying a predefined acoustic slow wave frequency based upon the particle sizes in said porous image layer thereby causing the fluid to move from an interior of said porous particulate image to an outer surface of said porous image, where fluid can be removed by conventional image.

6 Claims, 5 Drawing Sheets

ULTRASONIC DRYING OF SATURATED POROUS SOLIDS VIA SECOND SOUND

BACKGROUND AND SUMMARY

The present invention is directed to a method and apparatus for improving the quality of an image that is developed by a liquid carrier.

More specifically, images developed onto, transferred to, or written on paper and other output substrates by processes using liquid inks are known to leave liquid carrier in addition to small particulates comprising the image on that substrate. This residual fluid left in the image or paper is objectionable for a number of reasons: the carrier fluid is expensive and reuse is desirable; the carrier fluid may lend an objectionable feel or odor to the output print; the carrier fluid may present some level of health hazard. For these reasons it is necessary to remove the fluid, i.e., dry the print. Present methods of drying the fluid include, but are not limited to, evaporation of the fluid by application of a flux of hot air laterally over the surface; application of heat to the surface; removing the fluid via capillary action by contacting a material with small pores that wet easily by the fluid (i.e., blotting); wiping the surface with a low pressure blade, etc. In addition, it is possible to try to remove fluid from the particulate image by applying a pressure gradient across the image and substrate by either blowing or sucking normal to the surface.

These methods typically work well for removing the liquid carrier from the free surface of the image. The degree of success or rapidity of success decreases as the thickness of the particulate image increases. Fluid deep in the image is held by surface tension forces, and moves to the surface slowly, or not at all. This may necessitate lengthy drying processes that are undesirable for rapid process speed or for compact process hardware.

A need currently exits for a method of moving fluid carrier from within the particulate image to the surface, where other processes exist to remove it, as discussed above.

Cross reference is made to the following applications filed concurrently herewith: Ser. No. 09/699,862 entitled "Method For Improving Oil Recovery Using An Ultrasound Technique", 09/699,871 entitled "A Method For Removing Trapped Impurity Aggregates From A Filter", 09/699,804 entitled "Method for Dispersing Red And White Blood Cells", Ser. No. 699,882 entitled "An Ultrasonic Method For Improving Cleaning And Redispersal Of Saturated Particle Aggregates In Processes Using Liquid Inks", Ser. No. 09/699,939 entitled "Method For Manufacturing Process", and Ser. No. 09/699,703 entitled "Process and Apparatus for Obtaining Ink Dispersions by Subjecting the Liquid Inks to an Ultrasonic or Sonic Signal".

Other References

M. A. Biot, J. Acoust. Soc. Am. 28, 168 (1956).

M. A. Biot, J. Acoust. Soc. Am. 28, 179 (1956).

M. A. Biot, J. Appl. Phys. 33, 1482 (1962).

D. L. Johnson, T. J. Plona, and H. Kojima, J. Appl. Phys. 76(1), 115 (1994).

T. J. Plona, R. D'Angelo, and D. L. Johnson, "Velocity and attenuation of fast, shear, and slow waves in porous media", in IEEE 1990 *Ultrasonics symposium Proceedings,* Vol 3, B. R. McAvoy editor, IEEE, NY. (1991) 1233–1239.

S. Torquato, Appl. Mech. Rev. 44(2), 37 (1991).

J. E. White, *Seimic waves: radiation, transmission, and attenuation,* McGraw-Hill book Company, New York, N.Y., 1965, pg. 70.

J. C. Williams, *The packing of solid particles,* Chapman and Hall, Ltd. London, England 1968, pg. 34.

SUMMARY OF THE INVENTION

In accordance with the present invention, there is provided a method for drying a porous solid saturated with a fluid including the steps of subjecting the saturate porous image to an ultrasonic signal to release the fluid from the saturated porous image layer; removing the fluid from said saturated porous solid, said subjecting step includes applying a predefined acoustic slow wave frequency based upon the particle sizes in said porous image layer thereby causing the fluid to move from an interior of said porous particulate image to an outer surface of said porous image, where fluid can be removed by conventional image.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

Figure 1:
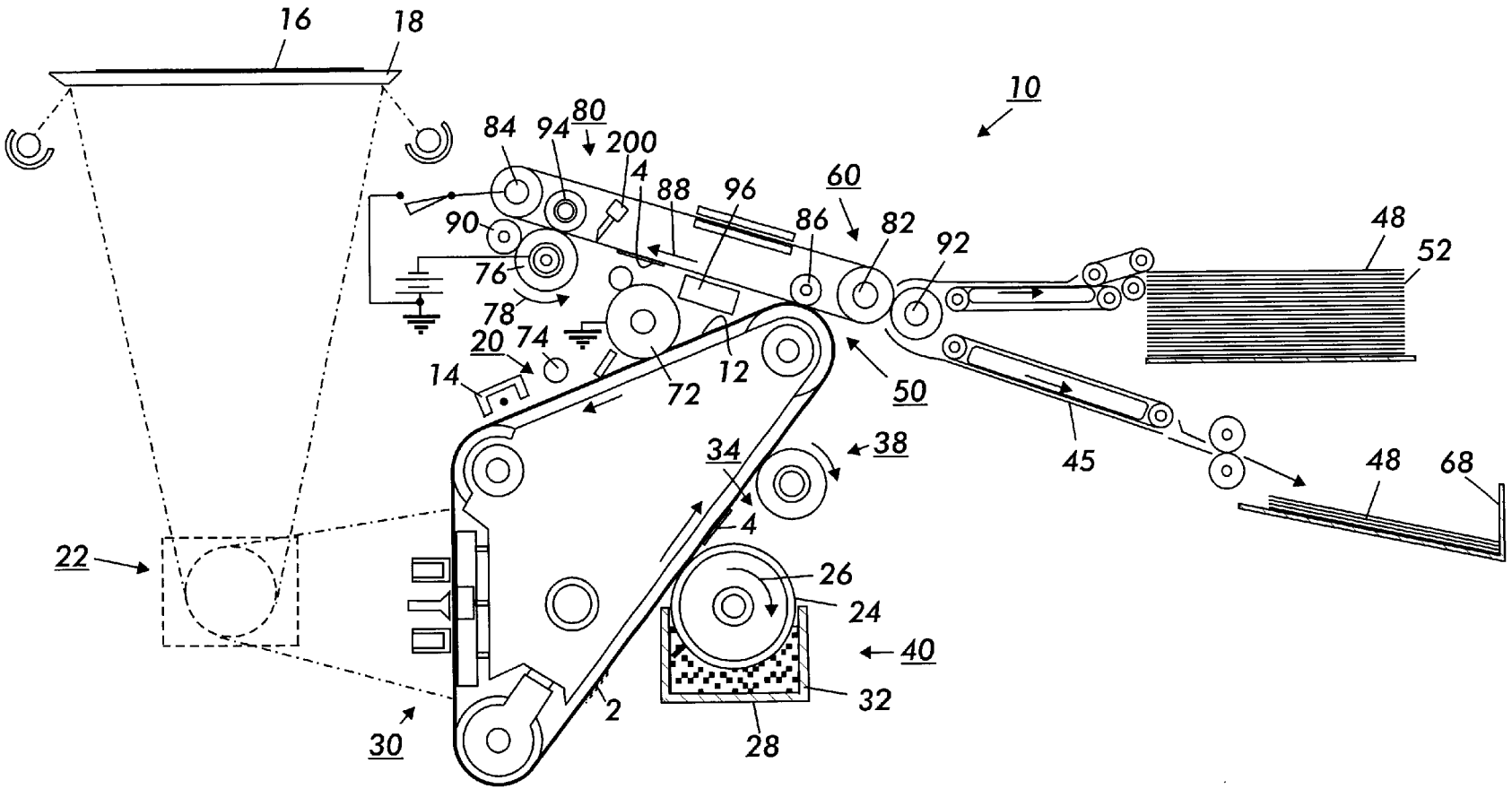
FIG. 1 contains a schematic illustration of a portion of an electrophotographic printing machine which uses an intermediate transfer belt to complete liquid image development.

Referring now to the drawings where the showings are for the purpose of describing an embodiment of the invention and not for limiting the same, in FIG. 1, reproduction machine 10 employs belt 12 having a photoconductive surface deposited on a conductive substrate.

Initially, belt 12 passes through charging station 20. At charging station 20, a corona generating device 14 changes the photoconductive surface of belt 12 to a relative high, substantially uniform potential. Once the photoconductive surface of belt 12 is charged, the charged portion is advanced to exposure station 30. An original document 16 which is located upon a transparent support platen 19 is illuminated by an illumination assembly, indicated generally by the reference numeral 22, to produce image rays corresponding to the document information areas. The image rays are projected by means of an optical system onto the charged portion of the photoconductive surface. The light image dissipates the charge in selected areas to reveal an electrostatic latent image 2 on the photoconductive surface corresponding to the original document informational areas.

After electrostatic latent image 2 has been revealed, belt 12 advances it to development station 40. At development station 40, roller 24, rotating in the direction of arrow 26, advances a liquid developer material 28 which includes toner particles dispersed substantially throughout a carrier fluid, from the chamber of housing 32 to development zone 34. The toner particles pass by electrophoresis to electrostatic latent image 2. The charge of the toner particles is opposite in polarity to the charge on the photoconductive surface when a CAD system is used, or identical in polarity in the case of a DAD system.

The specific ingredients used to make up the composition of the liquid electrostatic developer are described in U.S. Pat. No. 5,492,788 which is incorporated by reference. The liquid developers suitable for the present invention generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, carrier fluids such as Norpar 15® and Isopar L® or Superla® and Isopar L® or a mixture of two or more of the above fluids. The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight. Examples of charge directors include components such as (1) a protonated AB diblock copolymer of poly[2-dimethylammoniumethyl methacrylate bromide co-2-ethylhexyl methacrylate], poly [2-dimethylammoniumethyl methacrylate tosylate co-2-ethylhexyl methacrylate], poly[2-dimethylammoniumethyl methacrylate chloride co-2-ethylhexyl methacrylate], poly [2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], or poly [2-dimethylammoniumethyl methacrylate tosylate co-N,N-dibutylacrylamide]; (2) a mixture, for example 50:50, of at least two protonated AB diblock copolymers; (3) a mixture, for example 50:50, of at least one protonated AB diblock copolymer and one quarternized AB diblock copolymer, and the like. The charge directors as illustrated in the patents and copending applications mentioned herein can be selected from the developers of the present invention. The charge director can be selected for the liquid developers in various effective amounts, such as, for example, in embodiments from about 0.5 percent to 80 percent by weight relative to developer solids and preferably 2 percent to 20 percent by weight relative to developer solids. Developer solids include toner resin, pigment, and charge adjuvant. Without pigment the developer may be selected for the generation of a resist, a printing plate, and the like. Examples of other effective charge director for liquid toner particles include anionic glyceride, such as EMPHOS® D70–30C and EMPHOS® F27–85, two products sold by Witco Corporation, New York, N.Y., which are sodium salts of phosphated mono- and diglycerides with saturated and unsaturated substituents respectively, lecithin, Basic Barium Petronate, Neutral Barium Petronate, Basic Calcium Petronate, Neutral Calcium Petronate, oil soluble petroleum sulfonates, Witco Corporation, New York, N.Y., and metallic soap charge directors such as aluminum tristearate, aluminum distearate, barium, calcium lead, and zinc stearates; cobalt, manganese, lead, and zinc lineolates, aluminum, calcium, and cobalt octoates; calcium and cobalt oleates; zinc palmitate; calcium, cobalt, manganese, lead, zinc resinates, and the like. Other effective charge directors include AB diblock copolymers, of 2-ethylhexylmethacrylate-co-methacrylic acid calcium and ammonium salts. Any suitable thermoplastic toner resin can be selected for the liquid developers of the present invention in effective amounts of, for example, in the range of about 99 percent to 40 percent of developer solids, and preferably 95 percent to 70 percent of developer solids, which developer solids includes the thermoplastic resin, optional pigment and charge control agent, and any other component that comprises the particles. Examples of such resins include ethylene vinyl acetate (EVA) copolymers (ELVAX® resins, E.I. DuPont de Nemours and Company, Wilmington, Del.); copolymers of ethylene and an alpha.-.beta.-ethylenically unsaturated acid selected from the group consisting of acrylic acid and methacrylic acid; copolymers of ethylene (80 to 99.9 percent), acrylic or methacrylic acid (20 to 0.1 percent)/alkyl (C.sub.1 to C.sub.5) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic of methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an .alpha.-.beta.-ethylenically unsaturated acid of either acrylic acid or methacrylic acid. In a preferred embodiment, NUCREL®, like NUCREL 599®, NUCREL 699®, or NUCREL 960® are selected as the thermoplastic resin. The liquid developer of the present invention may optionally contain a colorant dispersed in the resin particles. Colorants, such as pigments or dyes and mixtures thereof, are preferably present to render the latent image visible. The colorant may be present in the resin particles in an effective amount of, for example, from about 0.1 to about 60 percent, and preferably from about 1 to about 30 percent by weight based on the total weight of solids contained in the developer. The amount of colorant selected may vary depending on the use of the developer. The amount of colorant selected may vary depending on the user of the developer. Examples of colorants include pigments like carbon blacks like REGAL 300®, cyan, magenta, yellow, blue, green, brown and mixtures thereof; pigments as illustrated in U.S. Pat. No. 5,223,368, the disclosure of which is totally incorporated herein by reference.

Development station 40 includes Low Solids Image Conditioner (LSIC) 38. LSIC 38 encounters the developed image 4 on belt 12 and conditions it by removing and reducing its liquid content, while inhibiting and preventing the removal of solid toner particles. LSIC 38 also conditions the image by electrostatically compacting the toner particles of the image. Thus, an increase in percent solids is achieved in the developed image, thereby improving the quality of the final image.

At transfer station 50, the developed liquid image 4 is electrostatically transferred to an intermediate member or belt indicated by reference numeral 80. Intermediate belt 80 is entrained about spaced rollers 82 and 84. Bias transfer roller 86 imposes intermediate belt 80 against belt 12 to assure image transfer to the intermediate belt 80.

Figure 2:
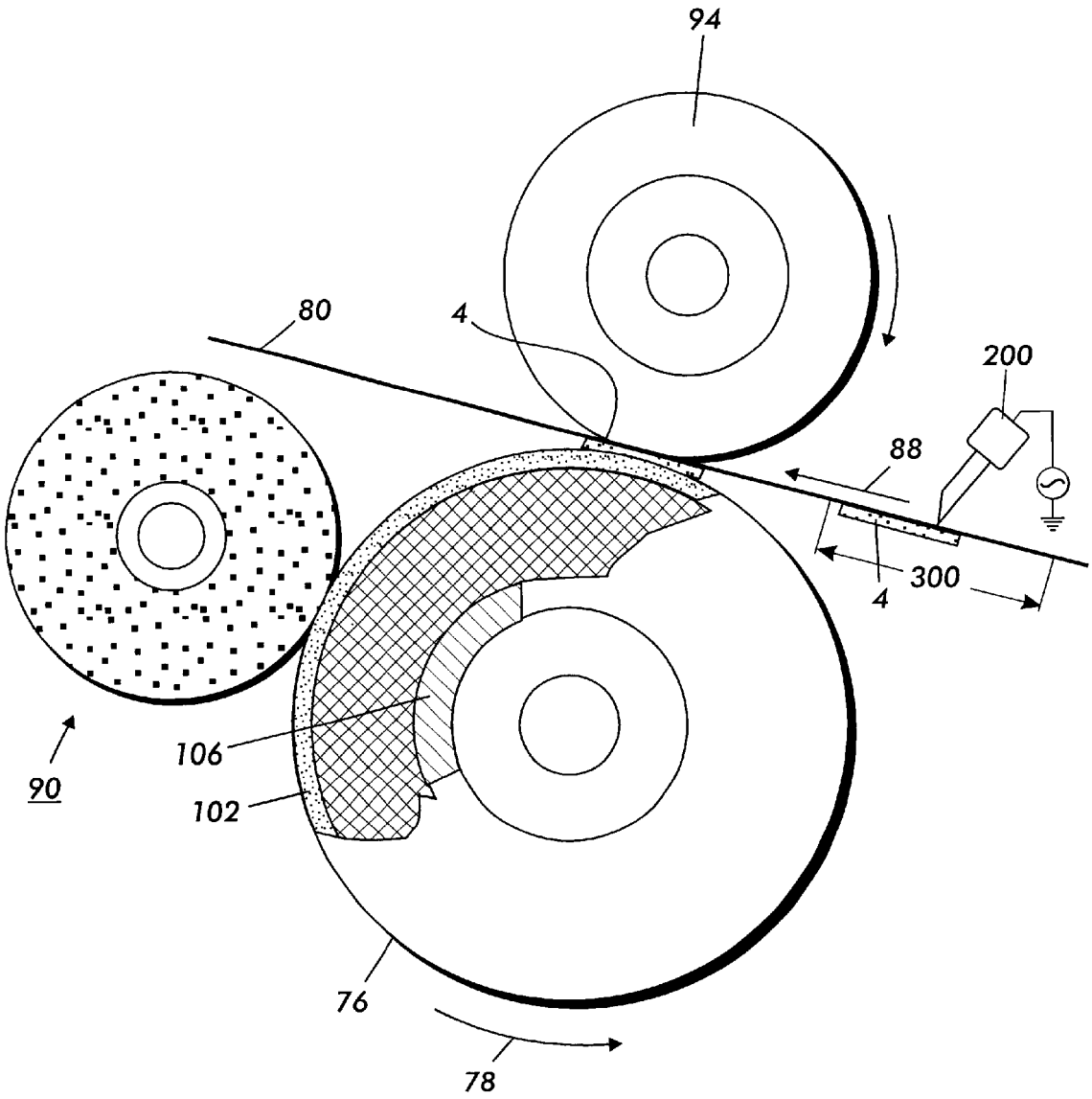
FIG. 2 contains a detailed illustration of the blotter roll placed next to the external vacuum application system of present invention.

Referring now to FIG. 2, piezoelectric horn 200 vibrates zones 300 of the intermediate belt as the image passes in zone 300. The present invention enhances fluid removal by subjecting the image to ultrasonic pressure waves at a specific frequency. Frequency used is the second sound frequency which results in the solids and the liquid responding out of phase to the driving wave. Fluid is forced through the pores structure of the solid. This results and the motion of the fluid from the interior of the porous solid to the surface, where it can be removed.

Developed image 4 is brought in contact with a High Solid Image Conditioning (HSIC) unit, which further increases the solid particle content of a contacting image. HSIC unit includes backing roll 94, as well as blotter roll 76 and vacuum application system 90.

The HSIC unit conditions developed image 4 on belt 80 by electrostatically compressing it, and additionally reducing its liquid content by removing fluid released by the ultrasonic frequency generated by piezoelectric horn 200, while preventing toner particles from departing from the image.

Blotter roll 76 and vacuum application system 90 remove carrier fluid from the surface of developed image 4 and transport it out of reproduction machine 10 for recycling or for collection and removal. More specifically belt 80, supported by backing roll 94 on its inside surface, transports developed image 4 past the HSIC unit. Blotter roll 76 is brought in contact with developed image 4 directly across from backing roll 94, causing carrier fluid to be absorbed from the surface of belt 80. Vacuum application system 90 then draws carrier fluid from blotter roll 76 and transports it away from the imaging system.

After vacuum system 90 removes fluid from blotter roll 76, the fluid is transported out of the reproduction machine for recycling or removal. Roll 76 continues to rotate past subsequent developed images 4. This provides for a continuous absorption of liquid from the surface of developed image 4 as blotter roll 76 is discharged of excess liquid due to its communication with vacuum system 90.

Belt 80 then advances the developed image to transfer/fusing station 60. At transfer/fusing station 60, a copy sheet 48 is advanced from stack 52 by a sheet transport mechanism, indicated generally by the reference numeral 54. Developed image 4 on the surface of belt 80 is attracted to copy sheet 48, and is simultaneously heated and fused to the sheet by heat from roller 82, for example. After transfer, conveyor belt 45 moves the copy sheet 48 to the discharge output tray 68. After developed image 4 is transferred to copy sheet 48, residual liquid developer material remains adhering to the photoconductive surface of belt 12.

This material may be removed using any of several well known suitable cleaning means 72, and any residual charge left on the photoconductive surface may be extinguished by flooding the photoconductive surface with light from lamps 74.

Figure 5:
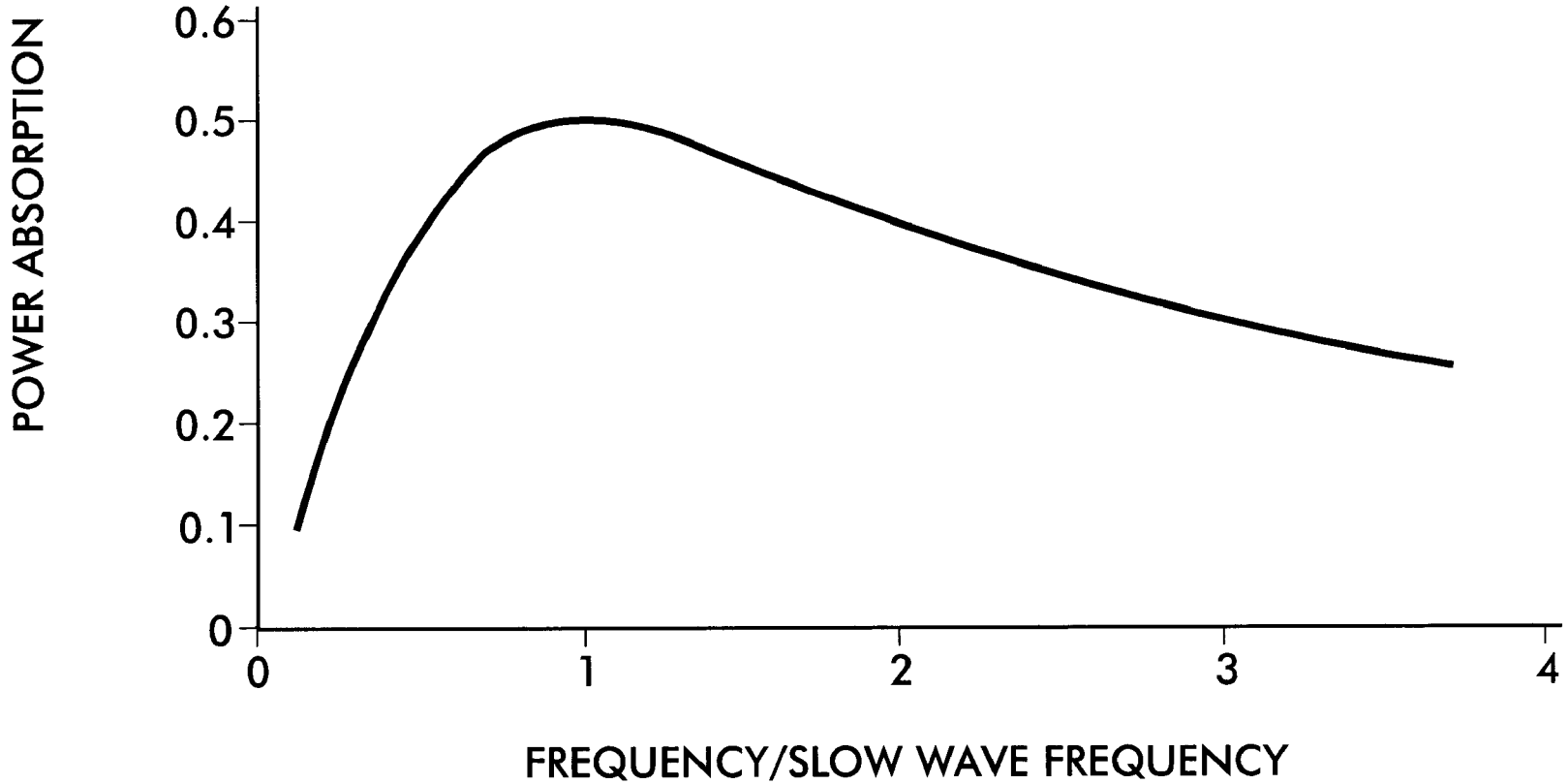
FIG. 5 is a graph of acoustic slow wave frequencies for various liquid developers used in present invention.

Typical acoustic slow wave frequencies are shown in FIG. 5 for aggregates composed of 2-micron particles in Isopar G, L, and M. As indicated in FIG. 5, as the percent solids in an aggregate decreases with breakup, the acoustic slow wave frequency that will have the maximum disruptive effective on the aggregate decreases.

In order to maintain the effectiveness of the ultrasonic vibration throughout it's excitation of an aggregate, the frequency of the driving source must either (1change with time, or preferably, (2) contain all of the appropriate frequencies at all times. Both frequency signatures are possible and potentially useful, and hence offer different embodiments of the invention. Thus, as indicated by FIG. 5, to track the releasing of fluid of an aggregate that starts at about 60% solids concentration, the source should be "white" over a frequency range of approximately 10–60 kHz (for an Isopar L pore fluid and 2 micron toner particles).

Having in mind the main elements of the present invention, and not wanting to be limited to theory, the present invention is believed to operate as follows: when a solid containing a fluid is subject to a sound wave, the fluid and the liquid will oscillate in the direction of propagation of the sound wave. In general, the fluid and the porous solid respond at slightly different rates. In the limit of very low frequency the porous solid and the liquid will respond completely in phase, resulting in no net motion of the fluid with respect to the porous solid.

As the frequency of the driving sound wave increases, the viscous fluid motion lags slightly behind that of the approximately rigid solid. This results in fluid motion through pores in the particulate solid.

As the frequency increases, the phase lag in relative motion between the solid and liquid also increases, at least up to a point. At a point called the acoustic slow wave point the motion of the solid and liquid will be 180 degrees out of phase. At the acoustic slow wave point we have the maximum amount of motion of the fluid with respect to the particulate solid. Thus, when excited at the acoustic slow wave frequency, on alternate sound wave half cycles the maximum amount possible of pore fluid is moved from previously inaccessible pores to the surface, where it can be removed by air drying, blotting, or other fluid removal system (see FIGS. 3 and 4).

Figure 3:
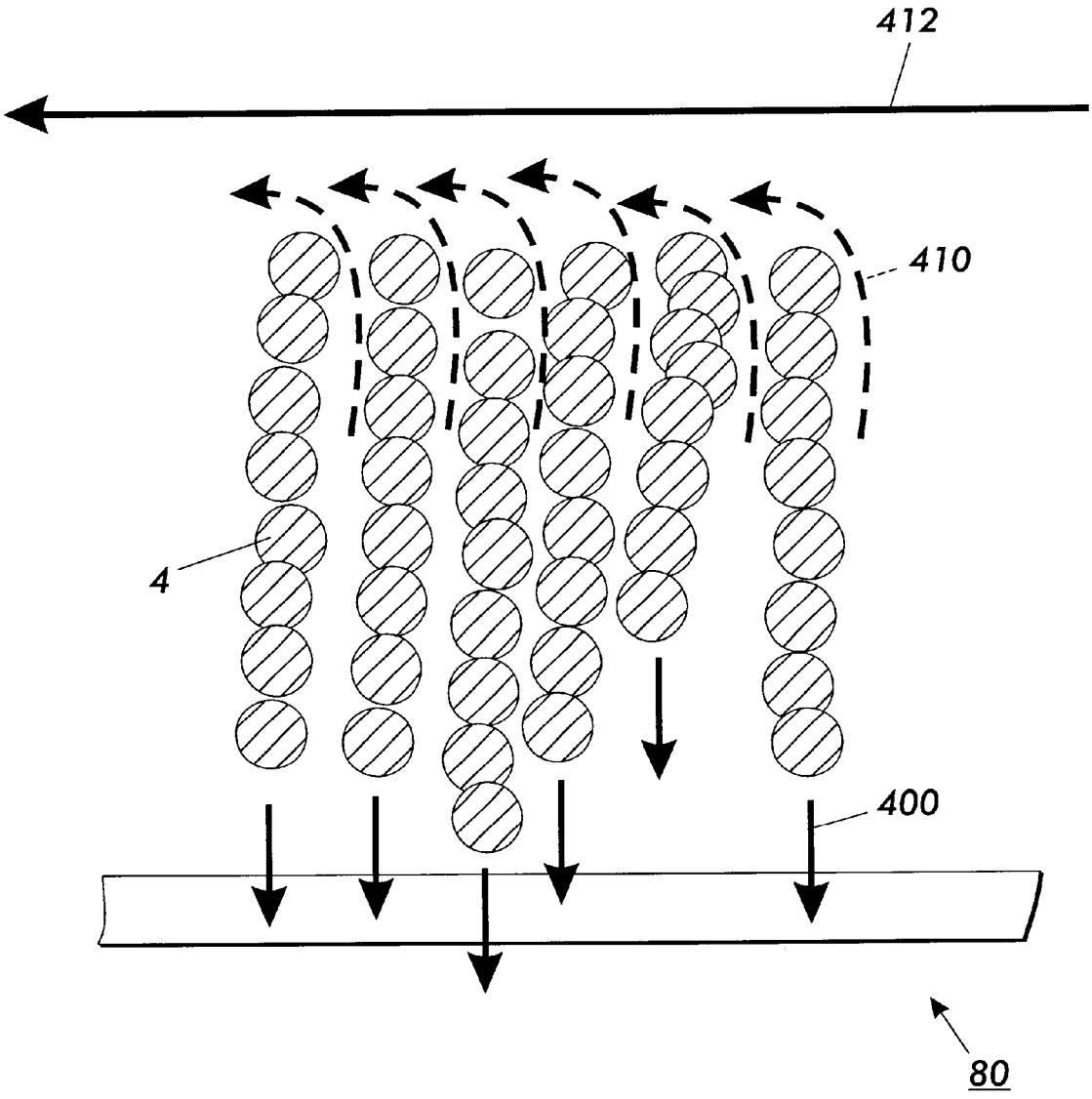
FIG. 3. illustrates an application of an acoustic slow wave normal to the surface of the image results in out of phase motion of the solid toner image and the remaining carrier fluid. At the image surface this brings previously inaccessible carrier fluid to the surface, where it can be evaporated by application of heat, or passage of heated air.

FIG. 3. Illustrates an application of an acoustic slow wave normal 400 to the surface of the image 4 results in out of phase motion of the solid toner image and the remaining carrier fluid. At the image surface this brings previously inaccessible carrier fluid illustrated by arrows 410 to the surface, where it can be evaporated by application of heat, or passage of heated air illustrated by arrows 412.

Figure 4:
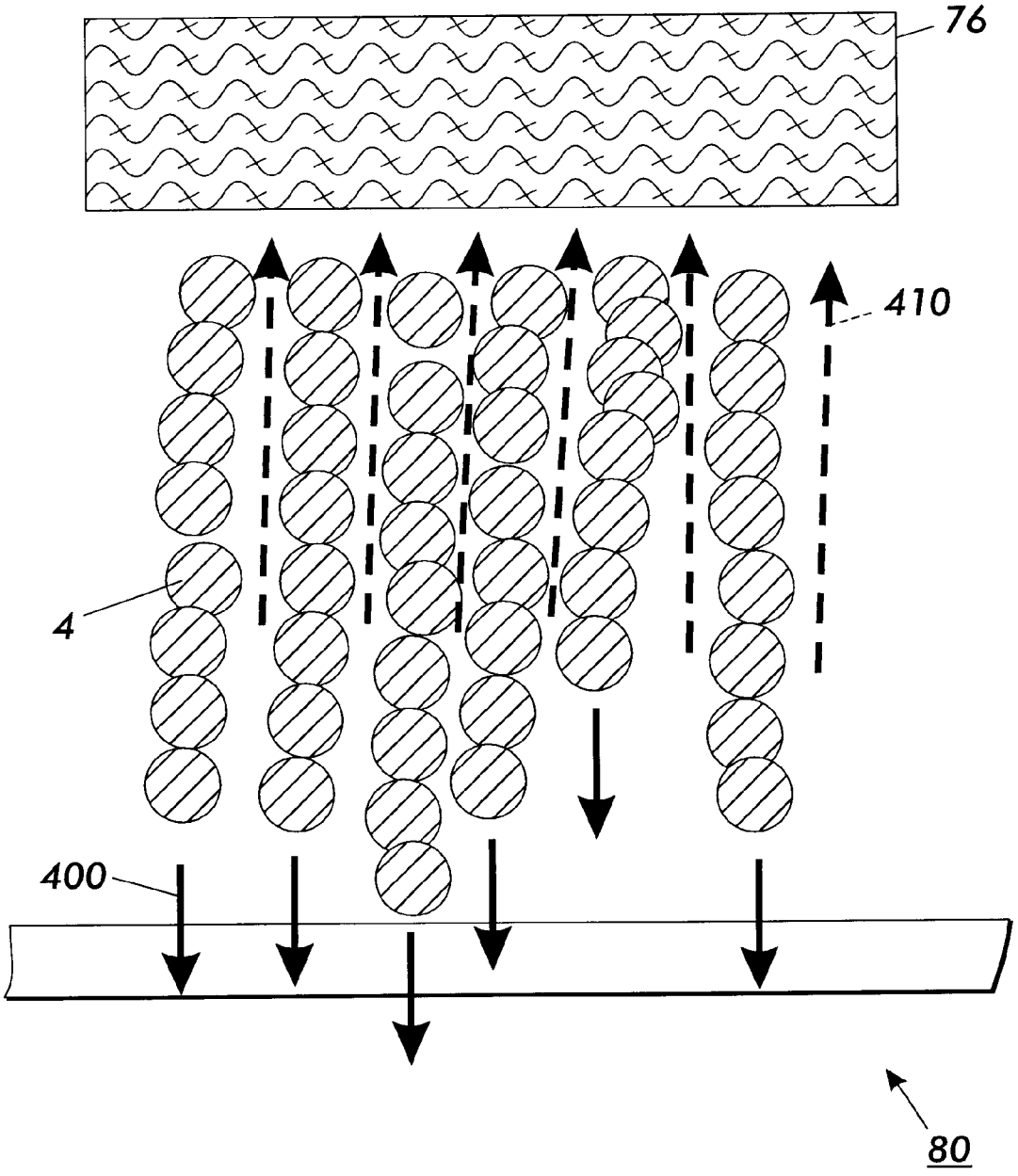
FIG. 4. Illustrates an application of an acoustic slow wave normal to the surface of the image results in out of phase motion of the solid toner image and the remaining carrier fluid. At the image surface this brings deep carrier fluid to the surface, where it can be removed by contact with a blotter roll.

FIG. 4. Illustrates an application of an acoustic slow wave normal 400 to the surface of the image results in out of phase motion of the solid toner image and the remaining carrier fluid. At the image surface this brings deep carrier fluid illustrated by arrows 410 to the surface, where it can be removed by contact with a blotter roll 76.

The first analysis of these different modes of fluid motion was carried out by Biot (1956a,b; 1962), and has been a topic of continuing research [see Johnson, Plona, and Kojima (1994) and references cited therein]. The acoustic slow wave mode is also sometimes called the "compressional slow wave" or just the "slow wave". These waves have been observed experimentally in a variety of porous solids, and are well-verified (Johnson, et. al., 1994).

The frequency of the acoustic slow wave mode, $f_c$, in an infinite porous solid is given by (White, 1965):

$$f_c=\eta\phi/(2\pi k\rho_f) \quad (1)$$

where $\eta$ is the fluid viscosity, $\phi$ is the particulate image porosity, k is the particulate image permeability, and $\rho_f$ is the fluid density. $\phi$ depends on the volume fraction of solids in the particulate image via:

$$\phi=1-(\%\ S/100) \quad (2)$$

where %S is the percent of solids in the image, by volume. This expression can be easily converted to reflect porosity in terms of percent S by weight.

It is obviously impossible (or at least very difficult) to directly measure the permeability of a thin particulate image layer. Therefore it is preferable to predict the image layer permeability. There are several ways in which this can be done. Variational bounds giving the upper and lower limits have been put on the permeability of particle composites [see e.g., Torquato (1991), and references cited therein]. There are also phenomenological relationship between the permeability and related quantities such as aggregate porosity. For this analysis we make use of the Carmen-Kozeny equation, which has the advantage of being a physically plausible form suggested by physical arguments, with a phenomenologically determined prefactor:

$$k=B\phi^3/\{S_v^2(1-\phi)^2\} \quad (3)$$

where B is a constant, typically on the order of 5, and $S_v$ is the particle surface area per unit volume within the particulate image. $S_v$ will depend on the particle size and packing of the particles, and is inversely proportional to particle diameter (Williams, 9168). Several specific particle packings have been used to calculate both $S_v$ (for use in Equations (1)–(3)) and % S in FIGS. (2) and (3), using information on the packings provided in Williams (1968). For example, for cubic close packing of particles, the porosity $\phi=0.476$, and $S_v=\pi/D$, where D is the particle diameter. For body centered cubic packing the porosity $\phi=0.395$, and $S_v=2\pi/D$. For face centered cubic packing the porosity $\phi=0.26$, and $S_v=4\pi/D$. For random packing the porosity $\phi=0.63$, and $S_v=\pi/D$. This information on $S_v$, plus Equations (2)–(3) allow the compressional slow wave frequency to be estimated by Eq.(1). This information on $S_v$, plus Equations (1) and (3) allow the compressional slow wave frequency to be estimated by:

$$f_c=\eta\{S_v^2(1-\phi)^2\}/(2\pi B\phi^2\rho_f). \quad (4)$$

Useful compressional slow wave frequency can be in the range between ±15% of the calculated or measured peak slow wave frequency.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method for drying a porous solid having a predefined particle size saturated with a fluid comprising the steps of:

subjecting the porous solid saturated to an ultrasonic signal to release the fluid from the porous solid saturated, said subjecting step includes applying a predefined acoustic slow wave frequency based upon the predefined particle size in said porous solid saturated thereby causing the fluid to move from an interior of said porous solid saturated to an outer surface of said porous solid saturated, where fluid can be removed; and removing the fluid from said saturated porous solid.

2. The method of claim 1, wherein said acoustic slow wave frequency determine by the following equation:

$$f_c=\eta\{S_v^2(1-\phi)^2\}/(2\pi B\phi^2\rho_f)$$

Where $f_c$ is the acoustic slow wave frequency, $\eta$ is the fluid viscosity, $S_v$ is the primary particle surface area per unit volume of the porous solid, $\phi$ is the porous solid porosity, $\rho_f$ is the fluid density, and B is a phenomenological constant.

3. The method of claim 2, wherein the ultrasonic frequency is about −15% to +15% of $f_c$.

4. A method for drying a saturated porous image composed of liquid developer including toner particles and carrier fluid comprising the steps of:

subjecting the saturated porous image to an ultrasonic signal to release the carrier fluid from the saturated porous image, said subjecting step includes applying a predefined acoustic slow wave frequency based upon the particle sizes in said saturated porous image layer thereby causing the fluid to move from an interior of said saturated porous image to an outer surface of said saturated porous image; and removing the carrier fluid from said saturated porous image.

5. The method of claim 4, wherein is said acoustic slow wave frequency determine by the following equations:

$$f_c=\eta\{S_v^2(1-\phi)^2\}/(2\pi B\phi^2\rho_f)$$

Where $f_c$ is the acoustic slow wave frequency, $\eta$ is the fluid viscosity, $S_v$ is the primary particle surface area per unit volume of the toner particles, $\phi$ is the toner particles, $\rho_f$ is the fluid density, and B is a phenomenological constant.

6. The method of claim 5, wherein the ultrasonic frequency is about −15% to +15% of $f_c$.

* * * * *